US007073766B2

(12) United States Patent
Schwörer

(10) Patent No.: US 7,073,766 B2
(45) Date of Patent: Jul. 11, 2006

(54) FORMWORK SYSTEM FOR CONCRETE BODIES

(75) Inventor: Artur Schwörer, Senden (DE)

(73) Assignee: Peri GmbH (DE)

( * ) Notice: Subject to any disclaimer, the term of this patent is extended or adjusted under 35 U.S.C. 154(b) by 90 days.

(21) Appl. No.: 10/428,054

(22) Filed: May 1, 2003

(65) Prior Publication Data

US 2004/0004174 A1 Jan. 8, 2004

(30) Foreign Application Priority Data

May 3, 2002 (DE) ..... 102 19 896

(51) Int. Cl.
*E04G 15/02* (2006.01)

(52) U.S. Cl. ..... 249/39; 249/180

(58) Field of Classification Search ..... 249/35, 249/39, 180, 184, 185, 186, 36, 37; 425/63
See application file for complete search history.

(56) References Cited

U.S. PATENT DOCUMENTS

| | | | | |
|---|---|---|---|---|
| 938,010 | A * | 10/1909 | Merriett | 249/39 |
| 1,560,976 | A * | 11/1925 | Cook | 249/39 |
| 1,623,151 | A * | 4/1927 | Wustholz | 249/180 |
| 3,822,853 | A * | 7/1974 | Shelley | 249/180 |
| 3,934,808 | A * | 1/1976 | Aizawa | 249/39 |
| 4,650,150 | A * | 3/1987 | Pacheco-Pifano | 249/180 |
| 4,666,388 | A * | 5/1987 | Kovasna et al. | 249/39 |
| 5,417,519 | A * | 5/1995 | Smuts | 249/180 |

FOREIGN PATENT DOCUMENTS

| | | |
|---|---|---|
| DE | 20 44 722 | 4/1971 |
| DE | 1684312 | 4/1971 |
| DE | 196 50 269 C1 | 4/1998 |
| DE | 198 00 568 C1 | 10/1999 |
| FR | 2 514 394 | 4/1983 |
| FR | 2514394 | 4/1983 |
| FR | 2 630 150 | 10/1989 |
| FR | 2692616 | 12/1993 |
| JP | 09209655 | 12/1997 |

* cited by examiner

*Primary Examiner*—Michael Safavi
(74) *Attorney, Agent, or Firm*—Walter A. Hackler

(57) ABSTRACT

A formwork system comprises an outer formwork, an inner formwork and an opening box-out. The opening box-out is rigidly connected to the outer formwork. The opening box-out can be reduced or enlarged in size by hinging a movable frame to its rigid inner frame. In the erected state of the formwork system, the opening box-out projects into an opening of the inner formwork. The opening of the inner formwork corresponds to the size of the recess to be formed on a concrete body. The inventive formwork system permits concreting of different wall thicknesses without changing the formwork system. Fitting of the opening box-out into a double-headed formwork can be omitted. Recess sizes and contours can be made more exact since the adjustable opening box-out is pressed on the inner edge of the opening in the second formwork shell.

3 Claims, 2 Drawing Sheets

FORMWORK SYSTEM FOR CONCRETE BODIES

BACKGROUND OF THE INVENTION

The invention concerns a formwork system for concrete bodies with recesses, consisting of an inner formwork, an outer formwork and an opening box-out (recessed formwork) disposed between the inner and outer formworks.

A formwork system of this type is disclosed e.g. in DE 198 00 568 C1.

The known opening box-out can be used to form an opening for a window, a door or the like in a concrete component. The opening box-out consists of reinforcing plates and side elements which, viewed in cross-section, have the shape of a T comprising a bridge and a transverse base disposed at one bridge end. The side elements can be disposed to parts of a formwork and can be connected to each other by means of reinforcing plates which can be mounted to the bridges. Reproducible shaping and mounting of the opening box-out is possible in the manner of a construction kit system with tools which are used on the building site and in a simple fashion. When the individual elements of the known opening box-out are produced from wood or a material comparable to wood, the opening box-out can be easily adapted or changed.

The depth of the known opening box-out must be permanently changed for casting concrete bodies of different thicknesses since the known opening box-out is disposed between a formwork with two heads and it must be ensured that there is no gap between the formwork shell of the inner and outer formworks and the opening box-out, into which not yet hardened concrete could flow during casting of the concrete body. The known opening box-out must be constructed, fitted and aligned between the formwork elements exactly according to the specifications. Although the known opening box-out permits lining of formwork in a relatively short time, the known opening box-out must always be newly constructed, adjusted and aligned for each recess to be produced. This requires a certain amount of time which cannot be reduced.

SUMMARY OF THE INVENTION

It is the underlying purpose of the present invention to produce a formwork system wherein the same formwork system can be used for the production of concrete bodies of different thicknesses and which facilitates erection of an opening box-out.

This object is achieved in accordance with the invention in that the opening box-out is mounted at one end to the outer or inner formwork, that the other end of the opening box-out engages in the bordering inner or outer formwork and/or penetrates same and that the outer contour of the opening box-out is movable such that the opening box-out can be reduced in size and be enlarged in size when it abuts a recess in the inner or outer formwork in which the opening box-out engages and/or which it penetrates.

The inventive formwork system thereby has the substantial advantage that it can be used for casting concrete bodies of different thicknesses comprising recesses without having to change the individual formwork elements.

Towards this end, the adjustable opening box-out which can be reduced or enlarged in size is mounted either to the inner side of an outer or inner formwork. This alone is advantageous in that the outer or inner formwork can be displaced together with the adjustable opening box-out for a new formwork process without requiring new adjustments or position checks of the opening box-out in the double-headed formwork.

The adjustable opening box-out which can be reduced or enlarged in size is associated with an inner or outer formwork comprising an opening which corresponds with the recess in the concrete body to be produced. The outer or inner formwork with mounted adjustable opening box-out, which is reduced in size, is displaced in the direction of the inner or outer formwork with the opening until the new opening box-out is mounted with its free end in the opening of the inner or outer formwork without opening box-out or at least projects towards or through the opening. Subsequently, the adjustable opening box-out is increased in size until it abuts and joins on all sides the inner periphery, i.e. the edge of the opening. In this state, the adjustable opening box-out is maintained at a stable pressure such that concreting can start after formwork processes which are known per se and not described herein. If the concrete body has hardened thereby keeping its shape, the adjustable opening box-out is reduced in size so that the outer formwork with mounted opening box-out can be withdrawn from the recess. If the opening box-out engages no longer in the opposite opening of the inner formwork or outer formwork and it is ensured that the outer or inner formwork to which the opening box-out is mounted, is displaced from the produced concrete body to such an extent that the opening box-out no longer engages in the produced recess of the concrete body, the outer formwork with mounted opening box-out and inner formwork including opening can be displaced.

The inventive formwork system permits production of concrete bodies of different thicknesses without changing the individual formwork elements. It must only be ensured that the free end of the adjustable opening box-out engages in the opening of the bordering inner or outer formwork. For the production of thinner concrete bodies, the outer or inner formwork with mounted opening box-out must be moved further into the opening of the bordering inner or outer formwork. If the desired concrete body thickness, e.g. a wall, is adjusted, the adjustable opening box-out can be enlarged until it abuts the edge of the opening. Abutment of the opening box-out on the opening edge also exactly determines the size of the recess which is to be produced when concreting the body, e.g. wall.

In one particularly preferred embodiment, the adjustable opening box-out consists of a rigid inner frame which is mounted to the outer or inner formwork and frame sections are adjustably hinged to the outer periphery of the inner frame which can be displaced via auxiliary means such as telescopic supports or spindles which can be extended or shortened, towards or away from the inner frame and the frame sections form, together with corner formwork elements which connect bordering frame sections or close a gap therebetween, an outer frame which can be pressed to the edge of the opening in the inner or outer formwork.

This is advantageous in that the adjustable opening box-out can be increased or reduced in size with simple means although the entire opening box-out is undetachably mounted to the outer or inner formwork. A rigid inner frame with predetermined size holds the articulated elements which form an adjustable outer frame in which frame sections formed on all sides in the outer region of the inner frame are connected to removable corner formwork elements (such as sheet metal angles which are screwed or mounted) to form a closed outer frame. The outer frame is enlarged via spindles or supports until it abuts on the inner edge of the opening in the bordering inner or outer formwork which represents the maximum size of the recess to be created. Exact recess edges and more exact recess sizes can be produced (concreted) since any bolt clearance of movable parts of the formwork system is eliminated. The size of the recess to be produced is determined by the size of the predetermined opening in the inner or outer formwork. The adjustable opening box-out is held e.g. via spindles in the desired size under stable pressure and is pressed to the edge of the opening.

In a further embodiment of the invention, spacers, in particular distance collars, are provided on the inner side of the outer or inner formwork to which the outer formwork is mounted.

This is advantageous in that the concrete bodies or wall thicknesses to be produced must not be measured again when erecting a formwork, but the outer or inner formwork are moved together until the free ends of the spacers abut the inner surface of the formwork shell of the bordering inner or outer formwork. The body thickness to be produced is set and the frame sections of the movable outer frame penetrate the opening of the bordering inner or outer formwork. The frame sections are subsequently moved away from the inner frame and bridged in the corner region with movable or removable corner formwork elements to produce a closed outer frame which abuts the opening edge of the opening. If the spacers are formed as distance collars, threaded bars can be guided in these distance collars which hold together the double-headed formwork with counter plates and butterfly nuts.

In a further embodiment of the invention, the upper end of the outer or inner formwork comprises a bracket which projects over the bracket-free inner or outer formwork and the bracket-free inner or outer formwork is suspended on the horizontal carrier section of the bracket and can be displaced along the carrier section.

This is advantageous in that this embodiment displaces the inventive formwork system and returns it into the embodiment for concreting even faster. If concreting is terminated and the concrete body has set such that the formwork can be removed, the formwork-connecting means are removed and the inner formwork is displaced along the bracket away from the concrete body produced. Subsequently, the outer formwork with mounted opening box-out is removed from the concrete body and the entire formwork, i.e. outer formwork with opening box-out and inner formwork can be displaced in one working step, and a new concreting section can be prepared at another location by displacing the inner formwork again towards the outer formwork until the adjustable opening box-out engages in the opening of the inner formwork to the desired extent i.e. as required for the concrete body thickness to be produced. The times for mounting and dismantling the formwork can be considerably reduced.

The inventive formwork system is advantageously part of climbing systems or automatic climbing systems. This is advantageous in that the inventive formwork system can be used with particular effectiveness for constructing tall buildings, when numerous identical concreting sections must be erected with the same recess sizes and recess shapes. For the construction of very tall buildings, usually the wall thickness is reduced from the first floor to the last floor. The inventive formwork system takes this into full consideration without having to substantially change the formwork system. Numerous repetitious recesses can be produced in the walls in successive concreting steps in that the entire formwork must be displaced in one working step when one concreting process is terminated. Towards this end, the outer and inner formworks must be moved apart and displaced and be joined again for the new concreting section. The higher the concreting section on a wall to be produced, the closer the distance between the outer and inner formwork to produce the same recess in the wall as on a wall section of a larger wall thickness.

The inventive formwork system provides a formwork system which meets in many ways the requirements of modern future building sites. Concreted wall sections with recesses can be produced without having to fit the recess in the formwork. The wall thickness of a concrete body can be varied with the same unchanged formwork in correspondence with displacement of the opening box-out in the opening of the bordering formwork. Errors in the construction of a recess size can be eliminated in that movable elements of the opening box-out abut edges of an opening thereby surrounding an exact size of a recess.

It is clear that the outer surface of the frame sections may extend also conically from one end to the other such that these frame sections can also produce recesses having inclined edges.

Further advantages of the invention can be extracted from the drawing. The features mentioned above and below can be used in accordance with the invention either individually or in any arbitrary combination. The mentioned embodiments are not to be understood as exhaustive enumeration but rather have exemplary character.

DESCRIPTION OF THE PREFERRED EMBODIMENT

Figure 1:
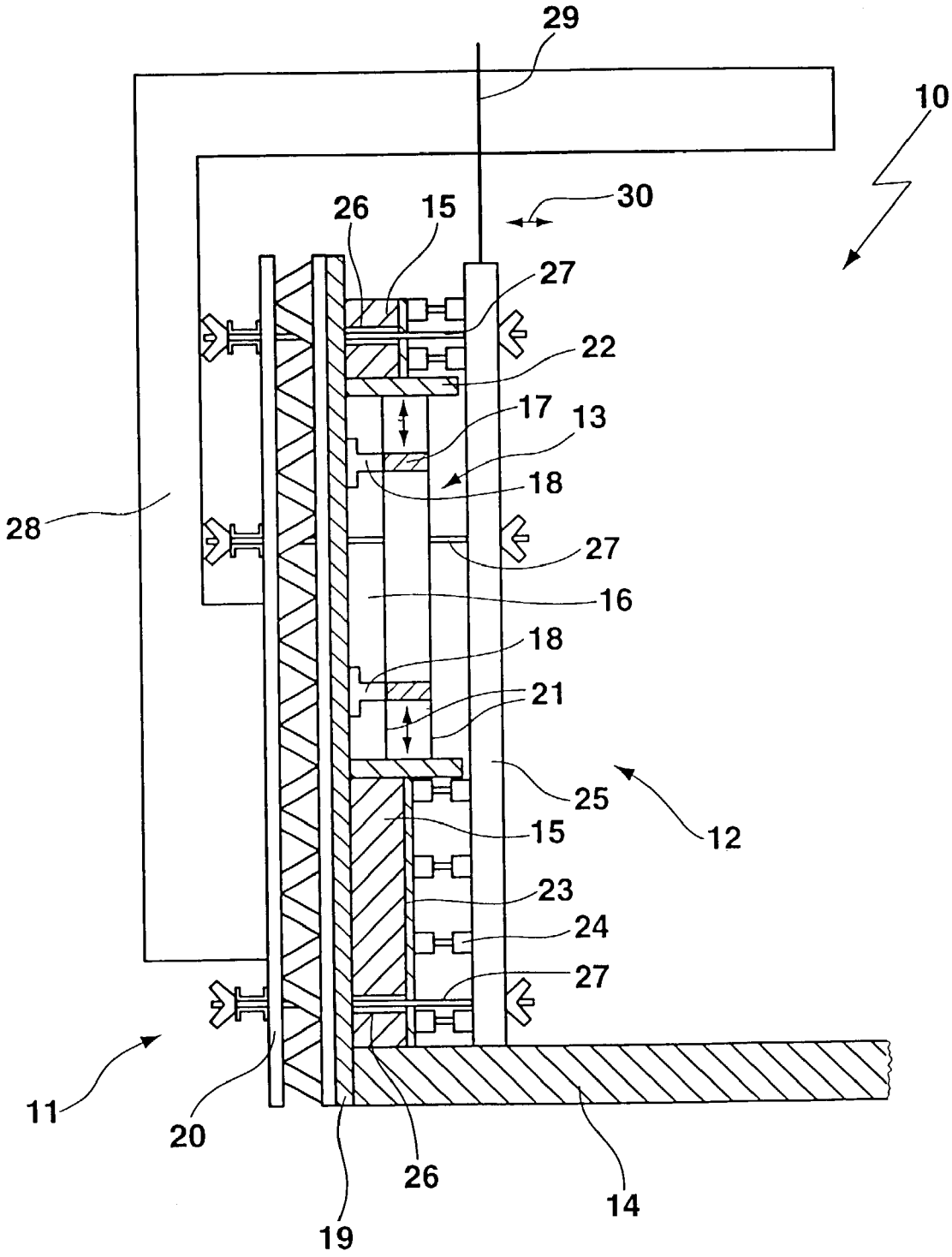
FIG. 1 shows a cross-sectional view of an inventive formwork system with a concrete body to be produced and a recess.

The two figures of the drawing show the inventive construction of the formwork system in a highly schematised fashion and individual features in the figures are not to be taken to scale. Individual features of the inventive formwork system are either highly enlarged or reduced in size to better show the construction of the inventive formwork system.

FIG. 1 shows with 10 a formwork system which consists of an outer formwork 11 (external formwork), an inner formwork 12 (internal formwork) and an adjustable opening box-out 13. A concrete body 15 with recess 16 is to be produced on a floor 14.

For producing the concrete body 15 with recess 16, the formwork system 10 is constructed in that the outer formwork 11 and inner formwork 12 are held together via formwork anchors. A rigid inner frame 17 of the adjustable opening box-out 13 is mounted to a first formwork shell 19 via supports 18. It is clear that the inner frame 17 may penetrate the formwork shell 19 for mounting to the outer formwork 11. An open-web girder 20 of the outer formwork 11 is shown which stabilizes the outer formwork 11.

In the embodiment of FIG. 1 the adjustable opening box-out 13 is rigidly connected to the outer framework 11 via the rigid inner frame 17. The outer periphery of the inner frame 17 comprises guide bars 21 which keep the frame sections 22 of the adjustable opening box-out 13 in an articulated fashion. The frame sections 22 abut the inner surface of the first formwork shell 19 and the frame sections 22 abut the front sides of a second formwork shell 23 which is part of the inner formwork 12. The second formwork shell 23 is supported by carriers 24 and bars 25.

The adjustable opening box-out 13 can be reduced or enlarged in size via the guide bars 21 by pivoting the guide bars 21 about pivot points formed on the inner frame 17. When the guide bars 21 are pivoted, the frame sections 22 can be displaced in the direction of arrows indicated between the guide bars 21.

Distance collars 26 are disposed on the outer formwork 11 such that they project over the surface formed by the first formwork shell 19. The length of the distance collars 26 determines the thickness of the concrete body 15 to be produced. The outer formwork 11 and the inner formwork 12 are moved that closely together that the free ends of the distance collars 26 abut the inner surface of the second formwork shell 23. Formwork anchors 27 can be guided through the distance collars 26 and have counter plates and/or butterfly nuts outside of the outer and inner formwork 11, 12.

A bracket 28 is indicated on the outer formwork 11 which is rigidly connected to the outer formwork 11. The inner formwork 12 is suspended on the horizontal support section of the bracket 28 via a suspension 29 which can be displaced in the direction of arrows 30, such that the inner formwork 12 can be distanced from the outer formwork 11 after releasing the formwork anchors 27. As soon as the concrete body 15 to be produced, in the present case a wall with a recess, has set into a stable form, the formwork anchors 27 can be released and the inner formwork 12 can be separated from the outer formwork 11. The guide bars 21 of the opening box-out 13 are pivoted via spindles or telescopic supports such that the adjustable opening box-out 13 is reduced in size and the frame sections 22 are separated from the produced concrete body 15 and from the edge of the opening in the second formwork shell 23. If the adjustable opening box-out 13 is reduced in size compared to the produced recess, the outer formwork 11 can be removed together with the adjustable opening box-out 13 which is mounted to the outer formwork 11 from the produced concrete body 15 and the outer formwork 11 and inner formwork 12 can be positioned together with the adjustable opening box-out 13 on a new concreting section.

Figure 2:
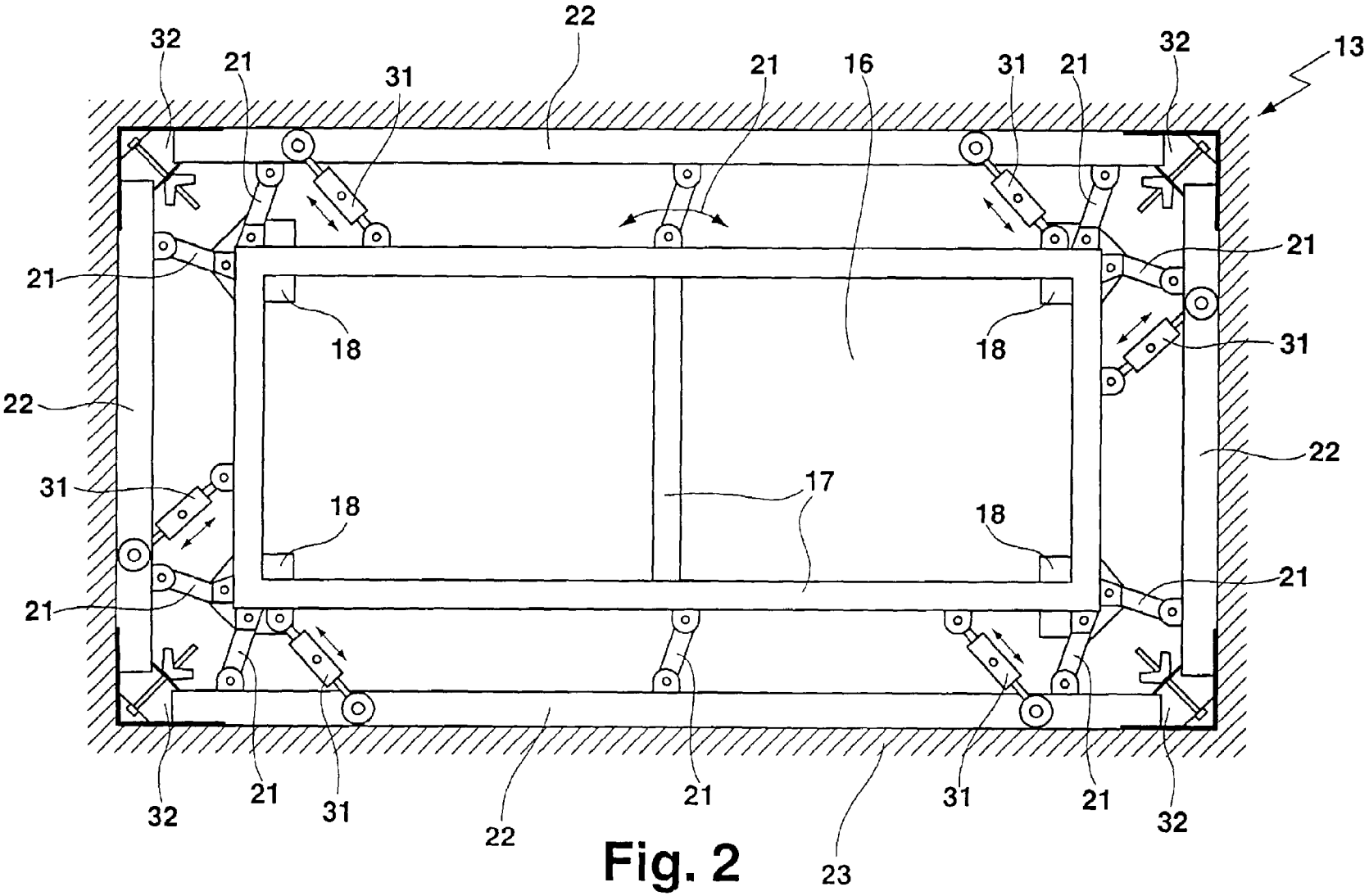
FIG. 2 shows the construction of an adjustable opening box-out of the inventive formwork system.

FIG. 2 shows the structure of an adjustable opening box-out 13 which is supported via edge sections 22 on front sides of the second formwork shell 23 and abuts there. An opening is cut out of the second formwork shell 23 of the inner formwork 12 as shown in FIG. 1 which corresponds to the size of the recess 16 which shall be recessed on a concrete body to be produced. The frame sections 22 extend over the entire depth of the concrete body to be produced and additionally abut the second formwork shell 23 or project over the second formwork shell 23 as shown in FIG. 1.

The rigid inner frame 17 is rigidly connected via supports 18 to the inner surface of an outer formwork. If outer formwork and adjustable opening box-out 13 and inner formwork are joined, the adjustable opening box-out 13 is rigidly positioned on the outer formwork 11 such that the opening box-out 13 projects, when reduced in size, in the opening of the inner formwork which is formed in the second formwork shell 23. It is clear that the adjustable opening box-out 13 may also be mounted to the inner formwork and a corresponding opening is provided on the outer formwork such that, when the outer formwork and inner formwork are joined, the free end of the opening box-out projects into a corresponding opening of the outer formwork.

Guide bars 21 are rotatably disposed on the outer periphery of the rigid inner frame 17 which keep the frame sections 22 movable. The guide bars 21 and thereby the frame sections 22 are moved via spindles 31 which can be extended or reduced in length in the direction of the arrows as shown in the figure. If the spindles 31 are reduced in length, the frame sections 22 approach the outer periphery of the rigid inner frame 17. If the spindles 31 are extended, the distance between the inner frame 17 and the frame sections 22 increases.

Before the frame sections 22 abut the front sides of the second formwork shell 23 by enlarging the adjustable opening box-out 13, corner formwork elements 32 are disposed in the region of bordering frame sections 22 which supplement the frame sections 22 to form a closed outer frame. The outer frame formed by the frame sections 22 and corner formwork elements 32 is held under stable pressure in abutment on the second formwork shell 23 via the spindles such that during concreting the space kept free by the adjustable opening box-out 13 remains free.

As soon as the concrete body to be produced is set having a stable form, the formwork can be removed by releasing the formwork anchors and corner formwork elements. Subsequently, the adjustable opening box-out can be reduced in size via the spindles 31. The outer formwork is subsequently separated from the inner formwork. The corner formwork elements can be removed. Embodiments are feasible wherein the corner formwork elements are only disposed on the outer surfaces of the frame sections.

A formwork system comprises an outer formwork, an inner formwork and an adjustable opening box-out. The adjustable opening box-out is rigidly connected to the outer formwork. The adjustable opening box-out can be reduced or enlarged in size by hinging a movable frame to a rigid inner frame. In the mounted state of the formwork system, the adjustable opening box-out projects into an opening of the inner formwork. The opening of the inner formwork corresponds to the size of the recess to be formed on a concrete body. The inventive formwork system provides concreting of different wall thicknesses without changing the formwork system. Fitting of the adjustable opening box-out in a double-headed formwork can be omitted. Recess sizes and contours can be made more exact since the adjustable opening box-out is pressed onto the inner edge of the opening in the second formwork shell.

I claim:

1. Formwork system for forming concrete bodies of a wall with recesses having a recess surface, the wall having an inner and an outer surface, the system comprising:

first formwork with an opening;

second formwork whereby one of said formworks is an inner formwork to form the inner surface of the wall and another is an outer formwork to form the outer surface of the wall;

an opening box-out disposed between the first formwork and the second formwork, the opening box-out being connected at one end thereof to the second formwork, the opening box-out including a rigid inner frame and adjustable frame sections surrounding the rigid inner frame and coupled thereto by pivotable guide bars whereby the opening box-out provides a movable outer contour to form the recess surface for increasing and decreasing a size of the opening box-out as far as it abutts upon an inner periphery of the opening of the first formwork; said moveable outer contour comprising frame sections and interconnecting corner formwork elements, the frame sections being moveably hinged to an outer periphery of the inner frame;

means for moving the frame sections in order to increase and reduce the opening box-out size, the frame sections forming an outer frame pressable to an edge of the opening of the first formwork; and distance collars disposed on an inner side of one of the inner and outer formworks for mounting of the opening box-out.

2. The formwork system according to claim 1 wherein the formwork system is part of a climbing system.

3. The formwork system according to claim 1 wherein one of the inner and outer formworks is bracket-free and an upper end of the other one of the inner and outer formworks comprises a bracket for overlapping the bracket free formwork, the bracket free formwork being suspended on a horizontal support of the bracket and displaceable there along.

* * * * *